US011554926B2

(12) United States Patent
Kakuta et al.

(10) Patent No.: US 11,554,926 B2
(45) Date of Patent: Jan. 17, 2023

(54) SHEET CONVEYOR UNIT AND IMAGE FORMING SYSTEM INCLUDING SAME

(71) Applicant: KYOCERA Document Solutions Inc., Osaka (JP)

(72) Inventors: Masayuki Kakuta, Osaka (JP); Risa Hibino, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/219,445

(22) Filed: Mar. 31, 2021

(65) Prior Publication Data

US 2021/0309475 A1 Oct. 7, 2021

(30) Foreign Application Priority Data

Apr. 6, 2020 (JP) ..... JP2020-068377

(51) Int. Cl.
*B65H 5/36* (2006.01)
*B65H 5/06* (2006.01)
*B65H 37/04* (2006.01)

(52) U.S. Cl.
CPC ..... *B65H 5/36* (2013.01); *B65H 5/062* (2013.01); *B65H 37/04* (2013.01)

(58) Field of Classification Search
CPC ..... B65H 2402/62
See application file for complete search history.

(56) References Cited

U.S. PATENT DOCUMENTS

2002/0163118 A1* 11/2002 Inoue ..... B65H 5/38 271/162
2006/0239771 A1* 10/2006 Hayashi ..... B65H 1/26 403/300
2008/0018040 A1* 1/2008 Tamura ..... B65H 29/12 271/3.14
2010/0090395 A1* 4/2010 Lewalski ..... B65H 9/12 271/248
2010/0316425 A1* 12/2010 Sasahara ..... B65H 5/36 271/226
2011/0215516 A1* 9/2011 Sugizaki ..... B65H 9/00 271/306
2019/0300320 A1 10/2019 Fuchi et al. ..... B65H 29/60

FOREIGN PATENT DOCUMENTS

JP 2019-172441 A 10/2019

* cited by examiner

*Primary Examiner* — Jennifer Bahls
(74) *Attorney, Agent, or Firm* — Stein IP, LLC

(57) ABSTRACT

A sheet conveyor unit is connected to downstream side of an upstream side unit in a sheet conveying direction. The sheet conveyor unit includes a convey guide for receiving a sheet discharged from outlet of the upstream side unit. The convey guide is constituted of a pair of guide members disposed to face each other with a predetermined space therebetween. The guide members have the same shape and include base parts having guide surfaces that form a sheet conveying path when combined to face each other, and inclined parts bent to directions apart from the guide surfaces from one end of the base parts in the sheet conveying direction so as to form a receiving port. The convey guide is attached selectively to one of positions different in at least one of a height direction and the sheet conveying direction with respect to an apparatus main body.

6 Claims, 7 Drawing Sheets

SHEET CONVEYOR UNIT AND IMAGE FORMING SYSTEM INCLUDING SAME

INCORPORATION BY REFERENCE

This application is based upon and claims the benefit of priority from the corresponding Japanese Patent Application No. 2020-068377 filed Apr. 6, 2020, the entire contents of which are hereby incorporated by reference.

BACKGROUND

The present disclosure relates to a sheet conveyor unit connected in an attachable and detachable manner to an upstream side apparatus such as an image forming apparatus, so as to covey a sheet received from the upstream side apparatus to a downstream side, and relates to the image forming system including the sheet conveyor unit.

Conventionally, there is known a sheet post-processing apparatus, which stacks sheets with images formed by an image forming apparatus such as a copier or a printer, and is capable of performing a stapling process of arranging and stapling the stacked sheets, a punching process of making punch holes by a punch hole forming device, and the like. When performing the post processing such as the stapling process on a relatively large amount of paper sheets, the sheet post-processing apparatus described above is used.

This sheet post-processing apparatus has a sheet inlet (hereinafter, simply referred to as an "inlet") for receiving a paper sheet discharged from a sheet outlet (hereinafter, simply referred to as an "outlet") of the image forming apparatus. Here, if the image forming apparatus sinks into a carpet on a floor, it may cause a mismatch in height between the outlet of the image forming apparatus and the inlet of the sheet post-processing apparatus. In addition, depending on a shape of a periphery of the outlet of the image forming apparatus or a shape of a periphery of the inlet of the sheet post-processing apparatus, they may interfere with each other, and hence the arrangement between the apparatuses may be restricted. In this case, there is a problem that a distance between the inlet and the outlet becomes relatively large so that a paper sheet discharged from the outlet can hardly be entered into the inlet.

Concerning this problem, there is known a sheet conveyor unit, which is disposed at the inlet of the sheet post-processing apparatus, so as to enter the paper sheet discharged from the outlet to the inlet. This sheet conveyor unit includes a convey guide consisting of pair of guide members, a receiving port formed on an upstream side end portion of the convey guide, and a rotation mechanism that can rotate the pair of guide members. The guide members extend from the inlet to the upstream side. The rotation mechanism rotates each of the pair of guide members so that an opening area of the receiving port can be adjusted. Because each guide member extends from the inlet to the upstream side in the sheet conveying direction, the receiving port is disposed on the upstream side of the inlet in the sheet conveying direction.

Because the receiving port is disposed on the upstream side of the inlet, the receiving port can be close to the outlet, even if the arrangement between the apparatuses is restricted so that the inlet of the sheet post-processing apparatus is relatively apart from the outlet of the image forming apparatus. Furthermore, because the opening area of the receiving port can be adjusted by the rotation mechanism, even if there is a mismatch in height between the outlet and the inlet, the height difference can be accommodated so that the receiving port can easily receive the paper sheet P. Therefore, this sheet conveyor unit is capable of easily entering the paper sheet P discharged from the image forming apparatus into the inlet of the sheet post-processing apparatus.

SUMMARY

A sheet conveyor unit according to an aspect of the present disclosure includes an apparatus main body disposed between an upstream side unit and a downstream side unit in a sheet conveying direction, and a convey guide disposed in an apparatus main body so as to receive a sheet discharged from an outlet of the upstream side unit and guide the same to the downstream side unit. The convey guide is constituted of a pair of guide members disposed to face each other with a predetermined space therebetween, and has a receiving port and a sheet conveying path. The receiving port opens at an upstream side end portion of the pair of guide members in the sheet conveying direction. The sheet conveying path extends from the receiving port toward the downstream side in the sheet conveying direction. The guide members have the same shape and include a base part and an inclined part. The base part has a guide surface for forming the sheet conveying path when the guide members are combined to face each other. The receiving port is bent in a separating direction from the guide surface from one end of the base part in the sheet conveying direction. The convey guide is attached selectively to one of a plurality of positions different in at least one of a height direction and the sheet conveying direction with respect to the apparatus main body.

Other objects of the present disclosure and specific advantages obtained by the present disclosure will become more apparent from the description of the embodiment given below.

DETAILED DESCRIPTION

Figure 1:
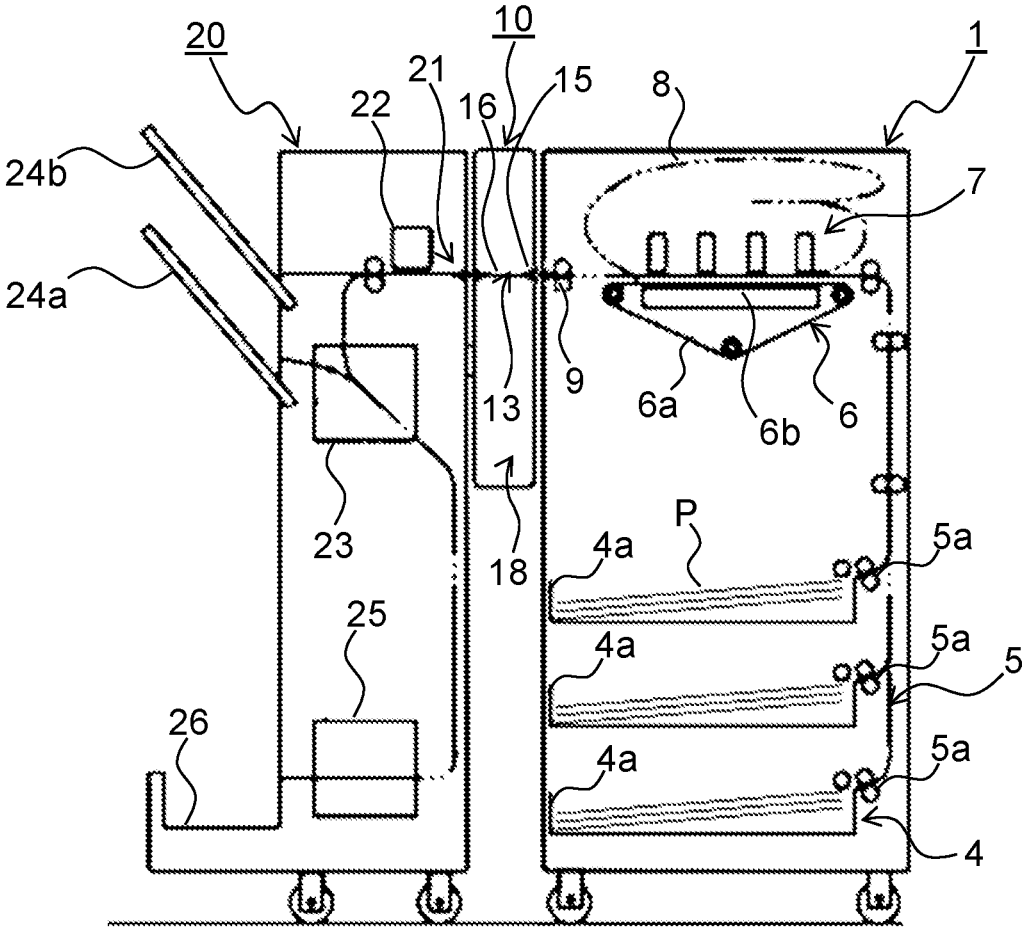
FIG. 1 is a schematic diagram illustrating internal structures of an image forming apparatus, a sheet conveyor unit, and a sheet post-processing apparatus, which constitute an image forming system.

Hereinafter, an embodiment of the present disclosure is described with reference to the drawings. FIG. 1 is a schematic diagram illustrating internal structures of an image forming apparatus (upstream side unit) 1, a sheet conveyor unit 10, and a sheet post-processing apparatus 20, which constitute an image forming system. First, with reference to FIG. 1, the image forming system is described, which is constituted of the image forming apparatus 1, the sheet conveyor unit 10 of the present disclosure, and the sheet post-processing apparatus 20. Hereinafter, the direction, in which a sheet discharged from the image forming apparatus 1 goes from an outlet of the image forming apparatus 1 through a convey guide 13 of the sheet conveyor unit 10 to an inlet 21 of the post processing apparatus, is referred to as a sheet conveying direction (an arrow X direction illustrated in each of FIGS. 2 to 7). In addition, in the sheet conveying direction, with respect to the convey guide 13, the side of the image forming apparatus 1 is referred to as an upstream side, while the side of the sheet post-processing apparatus 20 is referred to as a downstream side. In addition, a direction perpendicular to the sheet conveying direction is referred to as a sheet width direction (an arrow Y-Y' direction illustrated in each of FIGS. 3 to 5). In addition, the height direction is an up and down direction of the image forming apparatus 1, i.e. the direction perpendicular to both the sheet conveying direction and the sheet width direction (an arrow Z-Z' direction illustrated in each of FIGS. 2 to 4, 6, and 7).

As illustrated in FIG. 1, the image forming apparatus 1 is an inkjet recording type printer, and includes a sheet storing section 4 disposed in a lower part of the image forming apparatus 1, a sheet feeding section 5 disposed beside and above the sheet storing section 4, a sheet conveying section 6 disposed above the sheet storing section 4, an image recording section 7 disposed above the sheet conveying section 6 so as to face the same, and a reverse conveying section 8 disposed above the image recording section 7.

In the sheet storing section 4, a plurality of (e.g. three) sheet feed cassettes 4*a* in which paper sheets P are stored are disposed in an attachable and detachable manner. The sheet feeding section 5 feeds the paper sheet P stored in the sheet storing section 4 to the sheet conveying section 6, using a sheet feed roller pair 5*a* disposed on the downstream side of the sheet feed cassette 4*a* in a sheet feed direction.

The sheet conveying section 6 includes an endless conveyor belt 6*a* stretched around a plurality of rollers including a drive roller. The conveyor belt 6*a* has many air holes (not shown) for sucking air. The paper sheet P sent out from the sheet feeding section 5 is sucked by a sheet sucking section 6*b* disposed inside the conveyor belt 6*a* and held on the conveyor belt 6*a*, and in this state the paper sheet P passes below the image recording section 7.

The image recording section 7 includes a plurality of inkjet heads that eject ink to the paper sheet P sucked and held on the conveyor belt 6*a* while being conveyed. The inkjet heads are supplied with four color (cyan, magenta, yellow, and black) ink, respectively, stored in ink tanks (not shown), for each color of the inkjet head.

When printing on both sides of the paper sheet P, the reverse conveying section 8 switches (makes switchback of) the conveying direction of the paper sheet P after printing on one side, so that the paper sheet P is reversed upside down and then is conveyed again to the image recording section 7 with the side with no image recorded facing up. The paper sheet P with a predetermined image recorded by the image recording section 7 is discharged by the discharge roller pair 9 and is entered into the sheet conveyor unit 10.

The sheet conveyor unit 10 includes an apparatus main body 18 and the convey guide 13. The apparatus main body 18 is disposed between the image forming apparatus 1 and the sheet post-processing apparatus 20. The convey guide 13 is disposed in the apparatus main body 18, and enters the paper sheet P discharged from the image forming apparatus 1 to the sheet post-processing apparatus 20.

A receiving port 15 opens at an upstream side end portion of the convey guide 13. At the upstream side end portion of the convey guide 13, a sheet conveying path 16 is formed to extend from the receiving port 15 toward the downstream side in the sheet conveying direction. A downstream side end portion of the sheet conveying path 16 opens. The receiving port 15 can receive the paper sheet P discharged from the image forming apparatus 1. The sheet conveying path 16 is connected to a downstream side end portion of the receiving port 15. The sheet conveying path 16 can convey the paper sheet received by the receiving port 15 toward the downstream side. The paper sheet P discharged from the image forming apparatus 1 is received by the receiving port 15, passes through the sheet conveying path 16, and is entered into the inlet 21 of the sheet post-processing apparatus 20.

Inside the sheet post-processing apparatus 20, there are a punch hole forming device 22 that forms punch holes on the paper sheet P entered from the inlet 21, an edge binding unit 23 that stacks a plurality of the entered paper sheets P so as to align the edge of the paper sheets P and staple the same, and a middle-binding and middle-folding unit 25 that staples the paper sheets P in the middle and then folds the same along the staple line like a book. On a side surface of the sheet post-processing apparatus 20, there is a main tray 24*a* that can move up and down to a position suitable for discharge of the paper sheet P and a sub tray 24*b* that is fixed to an upper part of the sheet post-processing apparatus 20.

The punch hole forming device 22 is disposed in an upper part of the sheet post-processing apparatus 20. The paper sheet P with an image formed by the image forming apparatus 1 is supplied through the inlet 21 disposed at an upper right part of the sheet post-processing apparatus 20, passes through the punch hole forming device 22, and then is discharged onto the sub tray 24*b* as it is if a stapling process is not performed. If the stapling process is performed, the paper sheet P is conveyed to the edge binding unit 23 or the middle-binding and middle-folding unit 25 disposed below the punch hole forming device 22.

The edge binding unit 23 is constituted of a stapler and a processing tray (which are not shown), and the like. The front edges of the paper sheets P placed on the processing tray are aligned, and a batch of them is stapled at an end portion by the stapler disposed at an end portion of the processing tray, and then is discharged along the processing tray onto the main tray 24*a*.

The middle-binding and middle-folding unit 25 disposed below the edge binding unit 23 is constituted of a middle-binding stapler, a middle-folding device, and a sheet guide (which are not shown), and the like. The middle-binding stapler staples the center of the paper sheets P stacked in the sheet guide. A bunch of paper sheets P stapled by the middle-binding stapler is folded along the staple line like a book by the middle-folding device, and then is discharged onto a book tray 26.

Next, the sheet conveyor unit 10 is described with reference to FIGS. 2 to 7. The sheet conveyor unit 10 includes the apparatus main body 18 and the convey guide 13 described above, a pair of frames 12*a* and 12*b* disposed to face each other in the sheet width direction of the apparatus main body 18, and a guide attaching portion 14 that positions the convey guide 13 at one of positioning points with respect to the apparatus main body 18 and in this state can fix the same to the pair of frames 12*a* and 12*b*.

Figure 2:
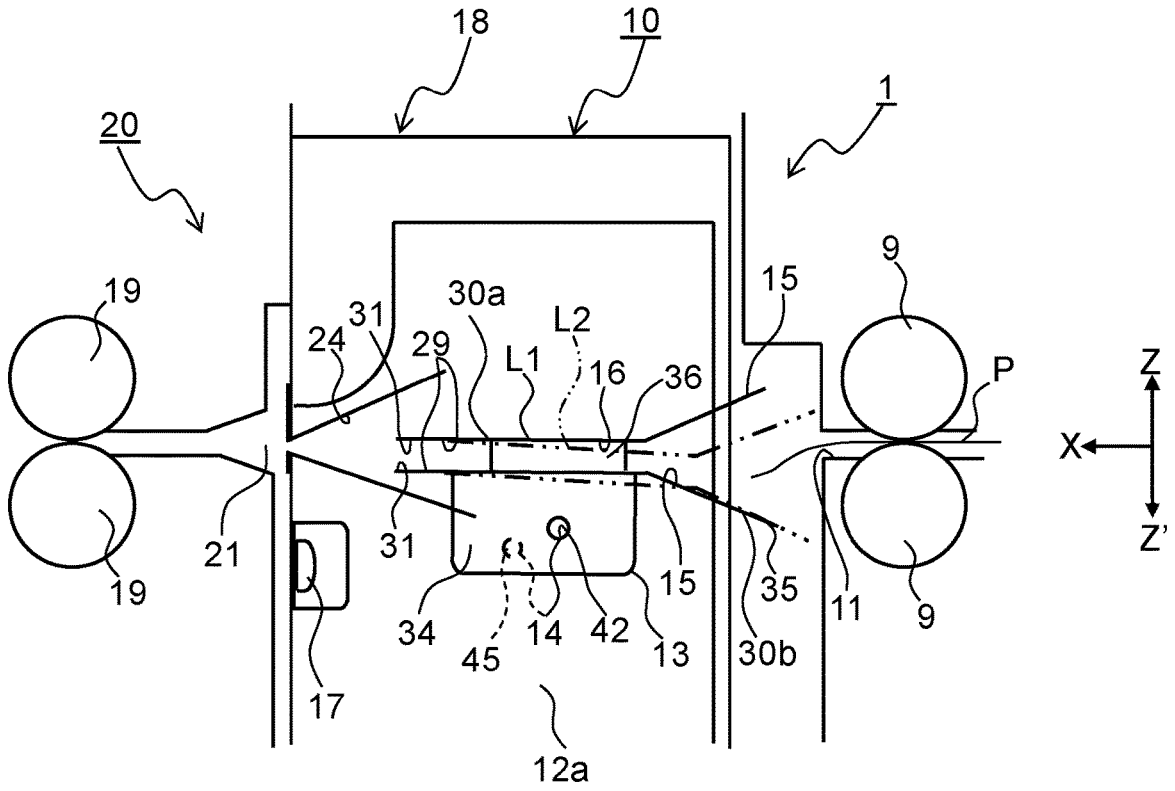
FIG. 2 is a schematic diagram illustrating an internal structure of the sheet conveyor unit.

First, with reference to FIGS. 2 to 5, the convey guide 13 is described. As illustrated in FIG. 2, the convey guide 13 has the receiving port 15 that opens at the upstream side end portion of the convey guide 13 in the sheet conveying direction, and the sheet conveying path 16 extending from the receiving port 15 toward the downstream side. The receiving port 15 opens to face an outlet 11 of the image forming apparatus 1 in the sheet conveying direction. The receiving port 15 is formed so that an opening width in the height direction is gradually increased toward the upstream side in the sheet conveying direction. The opening width of the upstream side end portion of the receiving port 15 is larger than the opening width of the outlet 11. In this way, the receiving port 15 can easily receive the paper sheet P discharged from the outlet 11.

The sheet conveying path 16 is connected to the downstream side end portion of the receiving port 15. The downstream side end portion of the sheet conveying path 16 opens and extends to a position inside an entering guide 24 disposed to face the inlet 21 of the sheet post-processing apparatus 20. In other words, the convey guide 13 extends from the receiving port 15 to the downstream side end portion of the sheet conveying path 16, with both ends opened in the sheet conveying direction, and the downstream side end portion is inserted in the entering guide 24. In this way, the convey guide 13 can receive the paper sheet P by the receiving port 15 and enter the same to the inlet 21 of the sheet post-processing apparatus 20 through the sheet conveying path 16. The paper sheet P entered into the inlet 21 is conveyed by an entering roller pair 19 disposed in the sheet post-processing apparatus 20 to the inside of the sheet post-processing apparatus 20.

Figure 3:
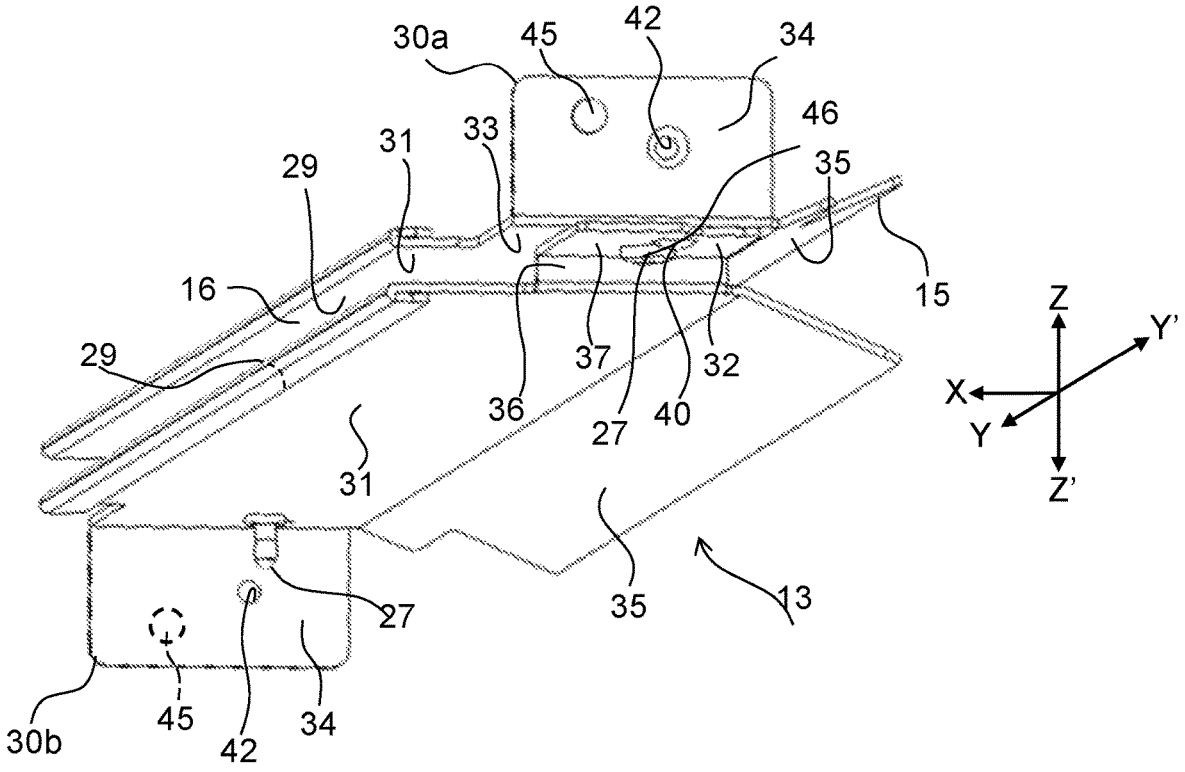
FIG. 3 is a perspective view illustrating a pair of guide members forming a convey guide.

As illustrated in FIGS. 2 and 3, the convey guide 13 is constituted of a pair of guide members 30*a* and 30*b* facing each other with a predetermined space therebetween in the height direction. The guide members 30*a* and 30*b* are the same type of members having the same shape. One guide member 30*a* out of the pair of guide members 30*a* and 30*b* is attached reversely to the other guide member 30*b* in the up and down direction and in the left and right direction. In other words, the one guide member 30*a* is reverse to the other guide member 30*b* in the height direction and in the sheet width direction. Therefore, in FIG. 3, if the one guide member 30*a* is rotated by 180 degrees about a rotation axis in the sheet conveying direction (the arrow X direction in the diagram), it coincides with the other guide member 30*b*. Therefore, even if the one guide member 30*a* at higher position and the other guide member 30*b* at lower position are exchanged, so that the one guide member 30*a* is disposed at lower position while the other guide member 30*b* is disposed at higher position, the same convey guide 13 as one before the exchange can be obtained. Hereinafter, the one guide member 30*a* out of the guide members 30*a* and 30*b* is described in detail, while the structure of the other guide member 30*b* is not described, using the same reference numerals. The structure of the other guide member 30*b* is, needless to say, the same as that of the one guide member 30*a*.

Figure 4:
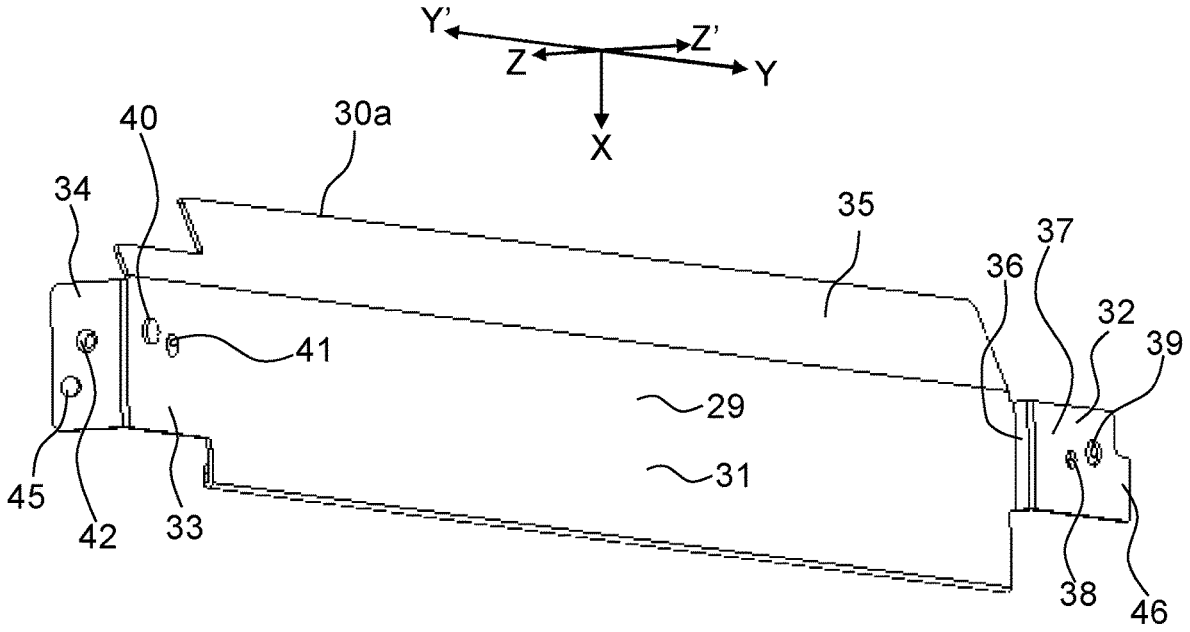
FIG. 4 is a perspective view illustrating one of the guide members.

As illustrated in FIGS. 3 and 4, the guide member 30*a* is a plate-like member elongated in the sheet width direction, including a base part 31, a joint part 32, a jointed part 33, a side wall part (mounting piece) 34, and an inclined part 35. The base part 31 has a rectangular flat shape. The base part 31 has a rectangular flat guide surface 29 facing one side in the height direction (Z' direction in the diagram). The joint part 32 is disposed at one end of the base part 31 in the sheet width direction. The joint part 32 and the guide surface 29 are adjacent to each other in the sheet width direction. The jointed part 33 is formed at the other end of the base part 31 in the sheet width direction (end portion opposite to the end portion at which the joint part 32 is disposed, out of both ends of the base part 31 in the sheet width direction). The side wall part 34 is disposed at an end portion outside the jointed part 33 in the sheet width direction.

The joint part 32 includes a leg part 36 rising from the one end of the base part 31 in the sheet width direction to the guide surface 29 side in the height direction perpendicularly to the base part 31, a flat plate-like joint piece 37 extending from the end portion of the leg part 36 outwardly in the sheet width direction (an arrow Y direction in the diagram) perpendicularly to the leg part 36, and an insertion piece 46 extending from the end portion of the joint piece 37 in the sheet width direction outwardly in the sheet width direction (the arrow Y direction in the diagram). The joint piece 37 has a through hole 38 and a positioning hole 39.

Figure 5:
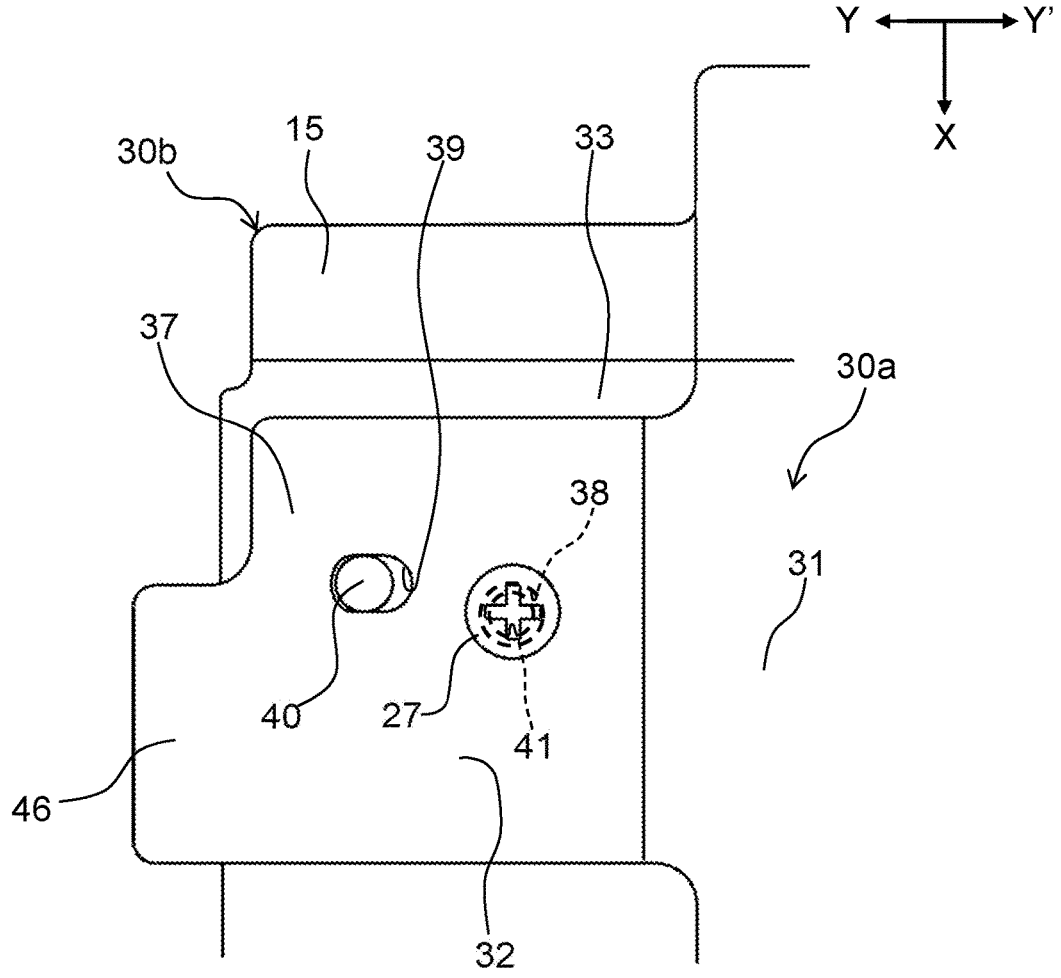
FIG. 5 is a partial enlarged view illustrating a joint part of one guide member and a jointed part of the other guide member, and their vicinity, viewed in an arrow Z' direction in FIG. 3.

FIG. 5 is a partial enlarged view illustrating the joint part 32 of the one guide member 30*a*, the jointed part 33 of the other guide member 30*b*, and their vicinity, viewed in the arrow Z' direction in FIG. 3. As illustrated in FIG. 5, the positioning hole 39 is located outer side of the through hole 38 in the sheet width direction. The positioning hole 39 is formed as a long hole having a major axis in the sheet width direction and a minor axis in the sheet conveying direction. The length of the insertion piece 46 in the sheet conveying direction is smaller than that of the joint piece 37. Therefore, the joint part 32 has a shape tapered outwardly in the sheet width direction from the joint piece 37 to the insertion piece 46.

With reference to FIG. 4 again, the jointed part 33 has a first positioning protrusion 40 and a first screw hole 41. The first positioning protrusion 40 is formed outside the first screw hole 41 in the sheet width direction. The first positioning protrusion 40 is a column protrusion that protrudes from the jointed part 33 in the height direction. The diameter of the first positioning protrusion 40 is slightly smaller than the minor axis of the positioning hole 39. The first screw hole 41 has a female thread on its inner periphery, to which a screw member 27 can be screwed in. The inner diameter of the first screw hole 41 is smaller than the inner diameter of the through hole 38 formed in the joint part 32. The inner diameter of the through hole 38 is larger than the outer diameter of the screw member 27. The space between the first positioning protrusion 40 and the first screw hole 41 is equal to the space between the positioning hole 39 and the through hole 38. In other words, the space between the first positioning protrusion 40 and the first screw hole 41 in the sheet conveying direction is equal to the space between the positioning hole 39 and the through hole 38 in the sheet conveying direction, and the space between the first positioning protrusion 40 and the first screw hole 41 in the sheet width direction is equal to the space between the positioning hole 39 and the through hole 38 in the sheet width direction.

As illustrated in FIG. 4, the side wall part 34 has a flat plate-like shape rising from the end portion of the jointed part 33 in the sheet width direction to the side (in an arrow Z direction in the diagram) opposite to the rising direction of the leg part 36 in the height direction. The side wall part 34 has a second positioning protrusion 45 and a second screw hole 42. The second positioning protrusion 45 is a protrusion that protrudes from the side wall part 34 outwardly in the sheet width direction. The second screw hole 42 has a female thread on its inner periphery, to which a screw member 28 can be screwed in (not shown).

The inclined part 35 has a flat plate-like shape elongated in the sheet width direction. The inclined part 35 extends from the end portion of the base part 31 on the upstream side in the sheet conveying direction toward the upstream side in the sheet conveying direction while inclining to the side (in the arrow Z direction in FIG. 4) opposite to the guide surface 29 side in the height direction. Therefore, the inclined part 35 is apart more from the guide surface 29 to one side in the height direction (in the arrow Z direction in FIG. 4) as being farther from one end of the base part 31 in the sheet conveying direction toward the upstream side in the sheet conveying direction. Therefore, the guide member 30*a* is bent so that the one end of the base part 31 in the sheet conveying direction (the end portion on the upstream side in the sheet conveying direction) becomes inside from the base part 31 to the inclined part 35.

As illustrated in FIG. 3, the base part 31 of the one guide member 30*a* and the base part 31 of the other guide member 30*b* face each other in the height direction so that the convey guide 13 is formed. The sheet conveying path 16 is formed between the guide surface 29 of the one guide member 30*a* and the guide surface 29 of the other guide member 30*b*. The space of the sheet conveying path 16 in the height direction is equal to the height of the leg part 36 (i.e. the space in the height direction between the base part 31 of the one guide member 30*a* and the joint piece 37 of the one guide member 30*a*). In addition, the receiving port 15 is formed between the inclined part 35 of the one guide member 30*a* and the inclined part 35 of the other guide member 30*b*.

As illustrated in FIGS. 3 and 5, the joint part 32 of the one guide member 30*a* abuts the jointed part 33 of the other guide member 30*b*. As illustrated in FIG. 5, the first positioning protrusion 40 of the other guide member 30*b* is inserted into the positioning hole 39 of the one guide member 30*a*. The first positioning protrusion 40 of the one guide member 30*a* is inserted into the positioning hole 39 of the other guide member 30*b* (not shown).

Here, as described above, the outer diameter of the first positioning protrusion 40 is slightly smaller than the minor axis of the positioning hole 39. Therefore, when the first positioning protrusion 40 is inserted into the positioning hole 39, the guide members 30*a* and 30*b* are positioned to each other in the sheet conveying direction. Further, the positioning hole 39 is formed as a long hole having the major axis in the sheet width direction. Therefore, the first positioning protrusion 40 is inserted into the positioning hole 39 with a clearance in the sheet width direction. Even if the position of the first screw hole 41 is shifted from a designed value in the sheet width direction, this clearance can accommodate the shift in the sheet width direction, and the guide members 30*a* and 30*b* can be positioned in the state where the first screw hole 41 and the through hole 38 match with each other.

The pair of guide members 30*a* and 30*b* are arranged so that the through hole 38 formed in the one guide member 30*a* and the first screw hole 41 formed in the other guide member 30*b* match with each other when they are positioned to each other in the sheet conveying direction, and the screw member 27 is screwed into the first screw hole 41 through the through hole 38, so that they are fastened to each other. In this case, because the screw member 27 passes through the through hole 38, the pair of guide members 30*a* and 30*b* are positioned in the sheet width direction.

Figure 6:
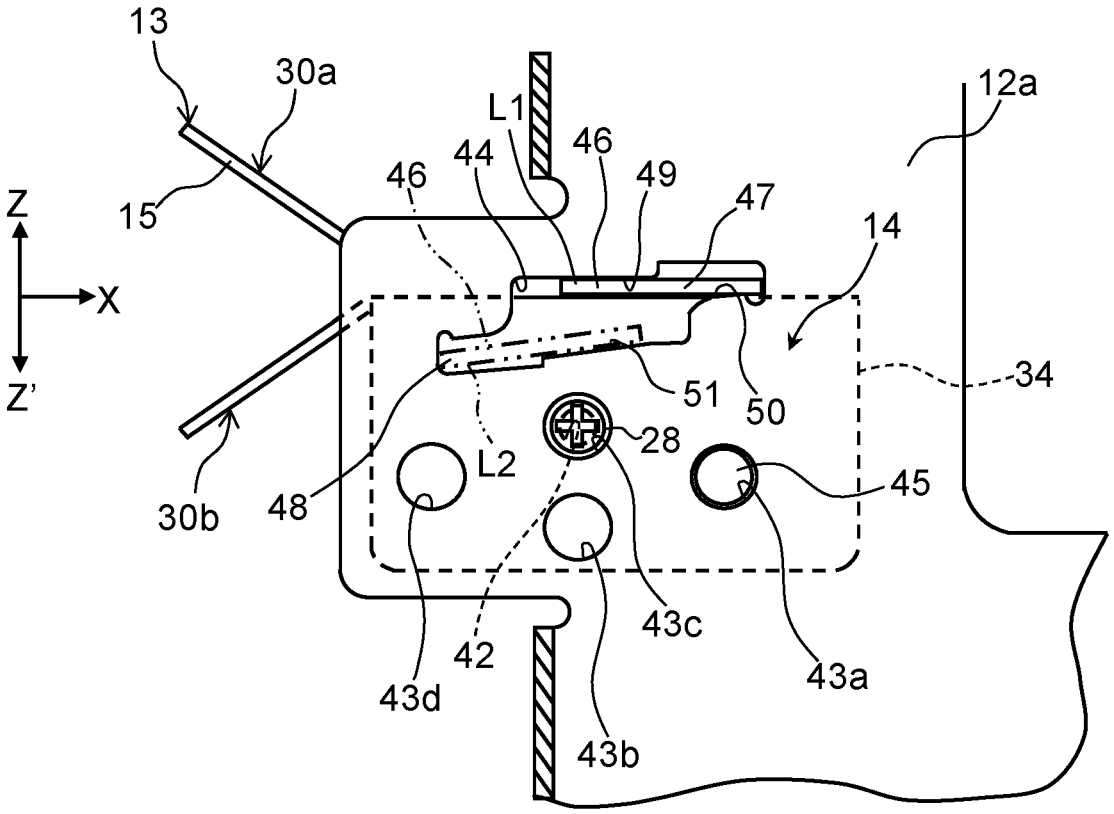
FIG. 6 is a cross-sectional view of one frame viewed from outside in a sheet width direction.
Figure 7:
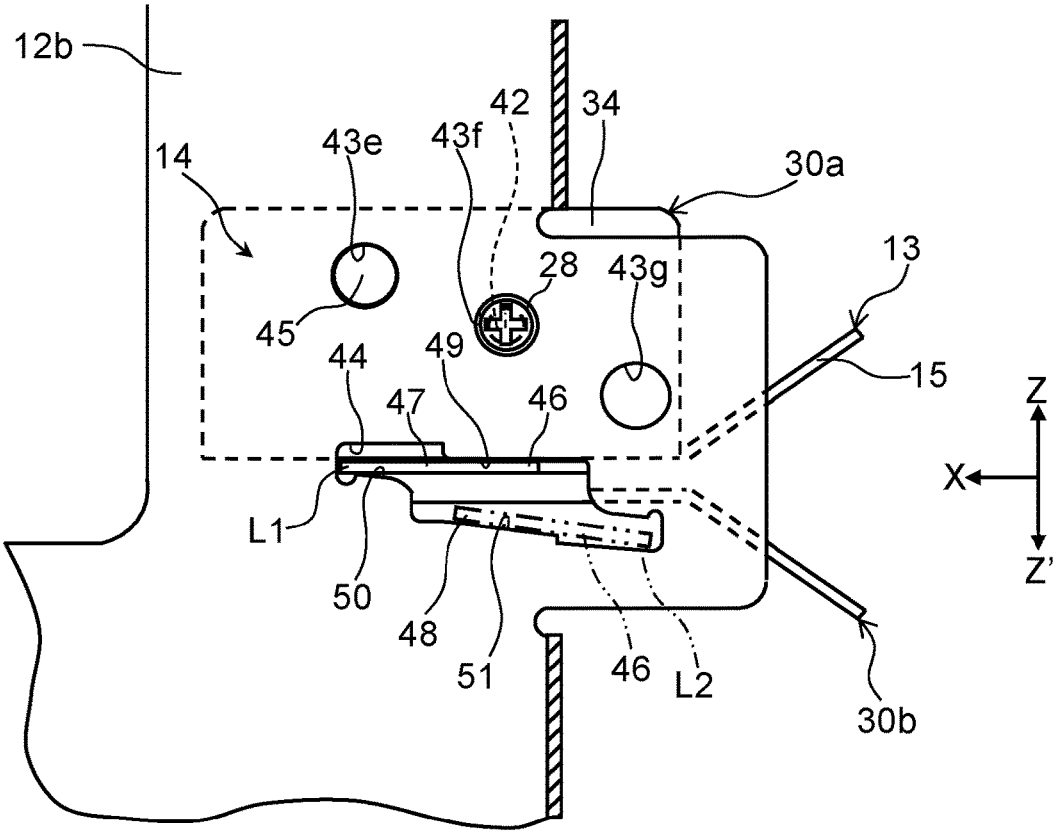
FIG. 7 is a cross-sectional view of the other frame viewed from outside in the sheet width direction.

Next, with reference to FIGS. 2, 6, and 7, the guide attaching portion 14 is described. As illustrated in FIG. 2, the guide attaching portion 14 can position the convey guide 13 to either a first positioning point L1 (illustrated in solid lines in FIG. 2) or a second positioning point L2 (illustrated in dashed double-dotted lines in FIG. 2). The convey guide 13 positioned to the first positioning point L1 is higher than the convey guide 13 positioned to the second positioning point L2 in the height direction, and the former is positioned on the downstream side of the latter in the sheet conveying direction. Therefore, the receiving port 15 of the convey guide 13 positioned to the first positioning point L1 is higher than the receiving port 15 of the convey guide 13 positioned to the second positioning point L2 in the height direction, and the former is positioned on the downstream side of the latter in the sheet conveying direction.

As illustrated in FIGS. 2, 6, and 7, the guide attaching portion 14 is constituted of a plurality of mounting holes 43*a* to 43*g* and an insertion hole 44 formed in the pair of frames 12*a* and 12*b*, and the second positioning protrusion 45 and the insertion piece 46 formed in the convey guide 13 (details of them will be described later). When the insertion piece 46 is inserted into the insertion hole 44 while the second positioning protrusion 45 is inserted into one of the mounting holes 43*a* to 43*g*, the convey guide 13 can be positioned to either the first positioning point L1 or the second positioning point L2. Hereinafter, with reference to FIGS. 6 and 7, a structure of the guide attaching portion 14 is described.

FIG. 6 is a diagram of the one frame 12*a* viewed from outside in the sheet width direction. FIG. 7 is a diagram of the other frame 12*b* viewed from outside in the sheet width direction. As illustrated in FIG. 6, the one frame 12*a* faces the side wall part 34 of the other guide member 30*b* in the sheet width direction. In addition, as illustrated in FIG. 7, the other frame 12*b* faces the side wall part 34 of the one guide member 30*a* in the sheet width direction.

As illustrated in FIGS. 6 and 7, each of the frames 12*a* and 12*b* has the insertion hole 44 and the plurality of mounting holes 43*a* to 43*g*. The insertion hole 44 includes a first positioning part 47 and a second positioning part 48. The first positioning part 47 is an area in the insertion hole 44 to which the insertion piece 46 is inserted when the convey guide 13 is positioned to the first positioning point L1. The second positioning part 48 is an area in the insertion hole 44 to which the insertion piece 46 is inserted when the convey guide 13 is positioned to the second positioning point L2. The first positioning part 47 is higher than the second positioning part 48 in the height direction, and the former is shifted from the latter to the downstream side in the sheet conveying direction.

A first positioning surface 49 and a second positioning surface 50 are formed on an inner peripheral portion of the first positioning part 47 of the insertion hole 44. A third positioning surface 51 is formed on an inner peripheral portion of the second positioning part 48 of the insertion hole 44.

The first positioning surface 49 is at a higher position than the second positioning surface 50 in the height direction. The first positioning surface 49 extends horizontally in the sheet conveying direction and is a surface facing down in the height direction. The second positioning surface 50 is a surface facing up in the height direction. The third positioning surface 51 is at a lower position than the second positioning surface 50 and is a surface facing up in the height direction. The third positioning surface 51 is inclined down in the height direction from the downstream side to the upstream side in the sheet conveying direction.

When the convey guide 13 is positioned to the first positioning point L1, the insertion piece 46 is inserted into the first positioning part 47 of the insertion hole 44. In this case, the upper surface of the insertion piece 46 abuts the first positioning surface 49. The lower surface of the insertion piece 46 abuts the second positioning surface 50. When the convey guide 13 is positioned to the second positioning point L2, the insertion piece 46 is inserted into the second positioning part 48 of the insertion hole 44 (as illustrated in a dashed double-dotted line in FIG. 6). In this case, the lower surface of the insertion piece 46 abuts the third positioning surface 51.

When at least one of the upper surface and the lower surface of the insertion piece 46 abuts the plurality of surfaces in the insertion hole 44 (the first positioning surface 49, the second positioning surface 50, and the third positioning surface 51), the convey guide 13 is positioned to the frames 12*a* and 12*b*.

As illustrated in FIG. 6, the one frame 12*a* has the plurality of mounting holes 43*a*, 43*b*, 43*c*, and 43*d*. The mounting holes 43*a* to 43*d* are at lower positions than the insertion hole 44 formed in the one frame 12*a*. The mounting holes 43*a* to 43*d* are formed with spaces between them in the sheet conveying direction and in the height direction.

Among the mounting holes 43*a* to 43*d*, the space between the mounting hole 43*a* on the most downstream side in the sheet conveying direction and the mounting hole 43*c* at the highest position is equal to the space between the mounting hole 43*b* at the lowest position and the mounting hole 43*d* on the most upstream side, and these spaces are equal to the space between the second positioning protrusion 45 and the second screw hole 42 formed in the side wall part 34 of the other guide member 30*b*.

When the convey guide 13 is positioned to the first positioning point L1, the second positioning protrusion 45 of the other guide member 30*b* is inserted into the mounting hole 43*a* of the one frame 12*a* on the most downstream side. In this case, the second screw hole 42 of the other guide member 30*b* matches with the mounting hole 43*c* of the one frame 12*a* at the highest position. When the screw member 28 is screwed into the second screw hole 42 so as to pass through this mounting hole 43*c*, the other guide member 30*b* can be secured to the one frame 12*a* in the state where the convey guide 13 is positioned to the first positioning point L1.

In addition, when the convey guide 13 is positioned to the second positioning point L2, the second positioning protrusion 45 of the other guide member 30*b* is inserted into the mounting hole 43*b* of the one frame 12*a* at the lowest position, and the second screw hole 42 of the other guide member 30*b* matches with the mounting hole 43*d* of the one frame 12*a* on the most upstream side (not shown). When the screw member 28 is screwed into the second screw hole 42 so as to pass through this mounting hole 43*d*, the other guide member 30*b* can be secured to the one frame 12*a* in the state where the convey guide 13 is positioned to the second positioning point L2.

As illustrated in FIG. 7, the other frame 12*b* has the plurality of mounting holes 43*e*, 43*f*, and 43*g*. The mounting holes 43*e* to 43*g* are at higher positions than the insertion hole 44. The mounting holes 43*e* to 43*g* are formed at sequentially lowered positions from the mounting hole 43*e* on the most downstream side toward the upstream side. In other words, among the mounting holes 43*e* to 43*g*, the mounting hole 43*f* at the middle in the sheet conveying direction is at a higher position than the mounting hole 43*g* on the most upstream side, and is at a lower position than the mounting hole 43*e* on the most downstream side.

Among the mounting holes 43*e* to 43*g* formed in the other frame 12*b*, the space between the mounting hole 43*f* at the middle in the sheet conveying direction and the mounting hole 43*e* on the most downstream side in the sheet conveying direction is equal to the space between the mounting hole 43*f* at the middle in the sheet conveying direction and the mounting hole 43*g* on the most upstream side in the sheet conveying direction. These spaces are equal to the space between the second positioning protrusion 45 and the second screw hole 42 formed in the side wall part 34 of the one guide member 30*a*.

As illustrated in FIG. 7, when the convey guide 13 is positioned to the first positioning point L1, the second positioning protrusion 45 of the one guide member 30*a* is inserted into the mounting hole 43*e* of the other frame 12*b* on the most downstream side. In this case, the second screw hole 42 of the one guide member 30*a* matches with the mounting hole 43*f* at the middle. When the screw member 28 is screwed into the second screw hole 42 so as to pass through this mounting hole 43*f*, the one guide member 30*a* can be secured to the other frame 12*b* in the state where the convey guide 13 is positioned to the first positioning point L1.

In addition, when the convey guide 13 is positioned to the second positioning point L2, the second positioning protrusion 45 is inserted into the mounting hole 43*f* of the other frame 12*b* at the middle. In this case, the second screw hole 42 of the one guide member 30*a* matches with the mounting hole 43*g* of the other frame 12*b* on the most upstream side (not shown). When the screw member 28 is screwed into the second screw hole 42 so as to pass through this mounting hole 43*g*, the one guide member 30*a* can be secured to the other frame 12*b* in the state where the convey guide 13 is positioned to the second positioning point L2.

As described above, the sheet conveyor unit 10 of the present disclosure includes the convey guide 13 having the receiving port 15 and the sheet conveying path 16, and hence can receive by the receiving port 15 the paper sheet discharged from the outlet 11 of the image forming apparatus 1, so as to convey the same through the sheet conveying path 16 toward the downstream side in the sheet conveying direction. Further, because the convey guide 13 is constituted of the pair of guide members 30*a* and 30*b* having the same shape, the sheet conveyor unit 10 can be constituted by a simple structure. Therefore, it is possible to provide the sheet conveyor unit including the convey guide 13 constituted by a simple structure, which can easily enter the paper sheet P conveyed from the upstream side apparatus to the sheet post-processing apparatus 20 on the downstream side, without depending on a state of a floor on which the image forming apparatus 1 and the sheet post-processing apparatus 20 are installed, shapes of the apparatuses, or the like.

In addition, because the guide attaching portion 14 is provided, the convey guide 13 can be positioned to either the first positioning point L1 or the second positioning point L2. The receiving port 15 of the convey guide 13 that is positioned to the first positioning point L1 is at a higher position than the receiving port 15 of the convey guide 13 that is positioned to the second positioning point L2, and the former is positioned on the downstream side of the latter in the sheet conveying direction. Therefore, even in a case where the sheet conveyor unit 10 is disposed to other image forming apparatus having different position of the outlet 11 or an upstream side unit other than the image forming apparatus, by positioning the convey guide 13 to either the first positioning point L1 or the second positioning point L2, the position of the receiving port 15 can be adjust so that the paper sheet P discharged from the outlet 11 can be easily received.

Other than that, the present disclosure is not limited to the embodiment described above but can be variously modified within the scope of the present disclosure without deviating from the spirit thereof. For instance, in the embodiment described above, an example in which the present disclosure is applied to the connection between the image forming apparatus 1 and the sheet post-processing apparatus 20 is described, but the present disclosure can also be applied to coupling between the image forming apparatus 1 and a relay conveyor apparatus, or coupling between the relay conveyor apparatus and the sheet post-processing apparatus 20. In addition, the present disclosure can also be applied to coupling between the image forming apparatus 1 and an insertion apparatus, when coupling the image forming apparatus 1 and the insertion apparatus for supplying a paper sheet during an interval between sheet supplies to the relay conveyor apparatus.

In addition, in the embodiment described above, the positioning hole 39 is formed in the joint part 32, while the first positioning protrusion 40 is formed in the jointed part 33, but it may be possible to adopt a structure in which the positioning hole 39 is formed in the jointed part 33, while the first positioning protrusion 40 is formed in the joint part 32. In addition, it may be possible to replace the first screw hole 41 by a simple through hole and to adopt a structure in which the pair of guide members 30*a* and 30*b* are fastened with a bolt and nut. Furthermore, it may be possible to replace the second screw hole 42 by a simple through hole and to adopt a structure in which the pair of guide members 30*a* and 30*b* are fixed to the frames 12*a* and 12*b* with a bolt and nut.

In addition, in the embodiment described above, the first positioning point L1 and the second positioning point L2 have different positions in both the height direction and the sheet conveying direction, but they may have different positions in only one of the directions.

In other words, it may be possible to adopt a structure in which the first positioning point L1 has the same position in the height direction but a different position in the sheet conveying direction with respect to the second positioning point L2. In this case, the first positioning protrusion 40 and the second screw hole 42 of the guide members 30*a* and 30*b* are formed at the same position in the height direction and with a space therebetween in the sheet conveying direction. Further, each of the frames 12*a* and 12*b* has the plurality of mounting holes 43*e* to 43*g* arranged at the same position in the height direction and with spaces therebetween in the sheet conveying direction. In addition, the first positioning part 47 and the second positioning part 48 of the insertion hole 44 are at the same position in the height direction and adjacent to each other in the sheet conveying direction.

In this case, when the convey guide 13 is positioned to the first positioning point L1, the second positioning protrusion 45 is inserted into the mounting hole 43*e* on the most downstream side among the plurality of mounting holes 43*e* to 43*g*. When the convey guide 13 is positioned to the second positioning point L2, the first positioning protrusion 40 is inserted into the mounting hole 43*f* at the middle in the sheet conveying direction among the plurality of mounting holes 43*e* to 43*g*. Therefore, the receiving port 15 of the convey guide 13 positioned to the first positioning point L1 is at the same position in the height direction as the receiving port 15 of the convey guide 13 positioned to the second positioning point L2, and the former is positioned on the downstream side of the latter in the sheet conveying direction.

In addition, for example, it may be possible to adopt a structure in which the first positioning point L1 has the same position in the sheet conveying direction but a different position in the height direction with respect to the second positioning point L2. In this case, the first positioning protrusion 40 and the second screw hole 42 of the guide members 30*a* and 30*b* are formed at the same position in the sheet conveying direction and with a space therebetween in the height direction. Further, each of the frames 12*a* and 12*b* has the plurality of mounting holes 43*e* to 43*g* arranged at the same position in the sheet conveying direction and with spaces therebetween in the height direction. The first positioning part 47 and the second positioning part 48 of the insertion hole 44 are at the same position in the sheet conveying direction and adjacent to each other in the height direction.

In this case, when the convey guide 13 is positioned to the first positioning point L1, the second positioning protrusion 45 is inserted into the mounting hole 43*e* at the highest position among the plurality of mounting holes 43*e* to 43*g*. When the convey guide 13 is positioned to the second positioning point L2, the second positioning protrusion 45 is inserted into the mounting hole 43*f* at the middle in the height direction among the plurality of mounting holes 43*e* to 43*g*. Therefore, the receiving port 15 of the convey guide 13 positioned to the first positioning point L1 is at the same position in the sheet conveying direction as the receiving port 15 of the convey guide 13 positioned to the second positioning point L2, and the former is at a higher position than the latter in the height direction.

In addition, in the embodiment, the guide attaching portion 14 is capable of positioning the convey guide 13 to the first positioning point L1 or the second positioning point L2, i.e. one of two positioning points, but it may be possible to add another positioning point to the first positioning point L1 and the second positioning point L2, as a positioning point that can be selected. In this case, each of the frames 12*a* and 12*b* has a plurality of mounting holes to which the second positioning protrusion 45 can be inserted when the convey guide 13 is positioned to the added positioning point.

In addition, in the embodiment described above, the pair of frames 12*a* and 12*b* are fixed to the sheet post-processing apparatus 20 with a fixing member 17 such as a screw (see FIG. 2). However, for example, they may be fixed to the image forming apparatus 1 with the fixing member 17.

In addition, although an inkjet printer is shown as an example of the image forming apparatus 1 in the embodiment described above, it is needless to say that the image forming apparatus 1 can be other than the inkjet printer, such as a copier, a laser printer, or a facsimile machine.

The present disclosure can be used for a sheet conveyor unit that is connected in an attachable and detachable manner to an upstream side apparatus such as an image forming apparatus, so as to convey a sheet received from the upstream side apparatus to the downstream side. Using the present disclosure, it is possible to provide the sheet conveyor unit constituted by a simple structure, which can easily enter a sheet conveyed from the upstream side apparatus to the downstream side apparatus, without depending on a state of a floor on which the apparatuses are installed, or a type of the sheet.

What is claimed is:

1. A sheet conveyor unit disposed between an upstream side unit and a downstream side unit in a sheet conveying direction, comprising:

an apparatus main body; and a convey guide disposed in the apparatus main body and configured to receive a sheet discharged from an outlet of the upstream side unit and to guide the sheet to the downstream side unit, wherein the convey guide includes a pair of guide members having the same shape disposed to face each other with a predetermined space therebetween, a receiving port opening at an upstream side end portion of the pair of guide members in the sheet conveying direction, and a sheet conveying path formed between the pair of guide members extending from the receiving port toward the downstream side in the sheet conveying direction, the pair of guide members has a pair of base parts with a pair of guide surfaces forming the sheet conveying path when combined to face each other, and a pair of inclined parts that is bent in directions away from each other from one ends of the pair of base parts in the sheet conveying direction and forms the receiving port, and the convey guide is selectively attached to any one of a plurality of positions different in at least one of a height direction and the sheet conveying direction with respect to the apparatus main body, wherein each of the pair of guide members includes a leg part bent toward each of the pair of guide surfaces from one end of each of the pair of base parts in a sheet width direction perpendicular to the sheet conveying direction, a joint part extending outward in the sheet width direction from the leg part, and a jointed part extending from the other end of each of the base parts, the joint part has a first positioning protrusion extending in the height direction, the jointed part has a positioning hole into which the first positioning protrusion can be inserted, and the pair of guide members is positioned relative to each other by inserting the first positioning protrusion into the positioning hole in a state in which the joint part of one of the pair of guide members and the jointed part of the other of the pair of guide members face to each other.

2. A sheet conveyor unit disposed between an upstream side unit and a downstream side unit in a sheet conveying direction, comprising:

an apparatus main body; and a convey guide disposed in the apparatus main body and configured to receive a sheet discharged from an outlet of the upstream side unit and to guide the sheet to the downstream side unit, wherein the convey guide includes a pair of guide members having the same shape disposed to face each other with a predetermined space therebetween, a receiving port opening at an upstream side end portion of the pair of guide members in the sheet conveying direction, and a sheet conveying path formed between the pair of guide members extending from the receiving port toward the downstream side in the sheet conveying direction, the pair of guide members has a pair of base parts with a pair of guide surfaces forming the sheet conveying path when combined to face each other, and a pair of inclined parts that is bent in directions away from each other from one ends of the pair of base parts in the sheet conveying direction and forms the receiving port, and the convey guide is selectively attached to any one of a plurality of positions different in at least one of a height direction and the sheet conveying direction with respect to the apparatus main body, wherein each of the pair of guide members includes a leg part bent toward each of the pair of guide surfaces from one end of each of the pair of base parts in a sheet width direction perpendicular to the sheet conveying direction, an L-shaped joint piece having a joint part extending outward in the sheet width direction from the leg part, and a jointed part extending from the other end of each of the base parts, one of the joint part and the jointed part has a first positioning protrusion extending in the height direction, the other of the joint part and the jointed part has a positioning hole into which the first positioning protrusion can be inserted, and the pair of guide members is positioned relative to each other by inserting the first positioning protrusion into the positioning hole in a state in which the joint part of the joint piece of one of the pair of guide members and the jointed part of the other of the pair of guide members face to each other.

3. The sheet conveyor unit according to claim 2, wherein one of the joint part and the jointed part has a through hole, the other of the joint part and the jointed part has a first screw hole, and through the through hole, the screw member is inserted into the first screw hole and is fastened so that the pair of guide members are assembled.

4. An image forming system comprising:

a relay conveyor unit as the sheet conveyor unit according to claim 2;

an image forming apparatus as the upstream side unit, for forming an image on the sheet; and a sheet post processing apparatus as the downstream side unit, for performing a predetermined post processing on the sheet.

5. A sheet conveyor unit disposed between an upstream side unit and a downstream side unit in a sheet conveying direction, comprising:

an apparatus main body; and a convey guide disposed in the apparatus main body and configured to receive a sheet discharged from an outlet of the upstream side unit and to guide the sheet to the downstream side unit, wherein the convey guide includes a pair of guide members having the same shape disposed to face each other with a predetermined space therebetween, a receiving port opening at an upstream side end portion of the pair of guide members in the sheet conveying direction, and a sheet conveying path formed between the pair of guide members extending from the receiving port toward the downstream side in the sheet conveying direction, the pair of guide members has a pair of base parts with a pair of guide surfaces forming the sheet conveying path when combined to face each other, and a pair of inclined parts that is bent in directions away from each other from one ends of the pair of base parts in the sheet conveying direction and forms the receiving port, and the convey guide is selectively attached to any one of a plurality of positions different in at least one of a height direction and the sheet conveying direction with respect to the apparatus main body, the sheet conveyor unit further comprising a pair of frames disposed to face each other in a sheet width direction perpendicular to the sheet conveying direction in the apparatus main body, wherein the pair of frames has a guide attaching portion capable of mounting the convey guide to one of a plurality of positioning points having different positions in at least one of the sheet conveying direction and the height direction, wherein each of the pair of guide members includes a leg part bent toward each of the pair of guide surfaces from one end of each of the pair of base parts in a sheet width direction perpendicular to the sheet conveying direction and a mounting piece extending from an end portion of the jointed part in the sheet width direction toward an opposite direction to the leg part, so as to face the frame, the guide attaching portion includes a second positioning protrusion protruding from the mounting piece outwardly in the sheet width direction, a plurality of second screw holes formed in the mounting piece, a plurality of mounting holes formed on the frame at different positions in at least one of the sheet conveying direction and the height direction, and a screw member, and the convey guide is positioned to the frame by inserting the second positioning protrusion into one of the plurality of mounting holes and is attached to the frame by inserting the screw member into the second screw hole and fastening the same.

6. The sheet conveyor unit according to claim 5, wherein each of the pair of guide members includes a joint part extending outward in the sheet width direction from the leg part, the guide attaching portion includes an insertion piece protruding outward from one end portion of the joint part of the guide member in the sheet width direction, and an insertion hole formed on the frame to which the insertion piece can be inserted, and the insertion piece is configured to abut a plurality of positioning surfaces formed on an inner peripheral surface of the insertion hole, so that the convey guide is positioned.

* * * * *